US008383571B2

(12) United States Patent
Wang et al.

(10) Patent No.: US 8,383,571 B2
(45) **Date of Patent: *Feb. 26, 2013**

(54) DUAL CHARACTER POLYMER USEFUL IN FABRIC CARE PRODUCTS

(75) Inventors: Xiaoru Jenny Wang, Mason, OH (US); Yonas Gizaw, Cincinnati, OH (US); Jeffrey Scott Dupont, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 318 days.

This patent is subject to a terminal disclaimer.

(21) Appl. No.: 12/562,229

(22) Filed: Sep. 18, 2009

(65) Prior Publication Data

US 2010/0075887 A1 Mar. 25, 2010

Related U.S. Application Data

(60) Provisional application No. 61/098,299, filed on Sep. 19, 2008.

(51) Int. Cl.
*C11D 3/22* (2006.01)
*C11D 3/37* (2006.01)

(52) U.S. Cl. ..... 510/470; 510/276; 510/471; 510/472; 510/474; 510/475; 510/492; 510/499; 510/505

(58) Field of Classification Search ..... 510/276, 510/470, 471, 472, 474, 475, 492, 499, 505
See application file for complete search history.

(56) References Cited

U.S. PATENT DOCUMENTS

| | | | | |
|---|---|---|---|---|
| 3,061,551 | A | 10/1962 | Rutenberg et al. | |
| 3,580,853 | A | 5/1971 | Parran | |
| 3,865,803 | A | 2/1975 | Falkehag | |
| 4,775,744 | A | 10/1988 | Schilling et al. | |
| 4,797,157 | A | 1/1989 | Dilling et al. | |
| 5,972,047 | A | 10/1999 | Dilling et al. | |
| 2003/0130159 | A1 * | 7/2003 | Hopkinson et al. | 510/475 |
| 2004/0171513 | A1 * | 9/2004 | Blokzijl et al. | 510/475 |
| 2010/0075878 | A1 | 3/2010 | Gizaw et al. | |
| 2010/0075879 | A1 | 3/2010 | Gizaw et al. | |
| 2010/0075880 | A1 | 3/2010 | Dupont et al. | |

FOREIGN PATENT DOCUMENTS

| | | | |
|---|---|---|---|
| DE | 10 2004 06376 | A1 | 7/2006 |
| EP | 0 752 468 | B1 | 8/2003 |
| EP | 1927616 | A2 | 6/2008 |
| EP | 1 194 461 | B1 | 10/2008 |
| GB | 699 530 | A | 11/1953 |
| WO | WO 98/29528 | A2 | 7/1998 |
| WO | WO 99/14245 | * | 3/1999 |
| WO | WO 99/14245 | A1 | 3/1999 |
| WO | WO 03/062254 | A1 | 7/2003 |
| WO | WO 2008/034674 | A1 | 3/2008 |
| WO | WO 2008/046174 | A1 | 4/2008 |
| WO | WO 2009/010911 | A2 | 1/2009 |

OTHER PUBLICATIONS

PCT International Search Report , date mailed Jan. 20, 2010, 17 pages.

* cited by examiner

*Primary Examiner* — Brian P Mruk

(74) *Attorney, Agent, or Firm* — Melissa G Krasovec

(57) ABSTRACT

New fabric care compositions including soil release polymers containing anionic substitution, nitrogen containing substitution, and alkoxy substitution are disclosed. In particular, fabric care compositions containing modified polysaccharides having anionic substitution, nitrogen containing substitution, and alkoxy substitution and methods of forming the same are disclosed.

12 Claims, No Drawings

DUAL CHARACTER POLYMER USEFUL IN FABRIC CARE PRODUCTS

CROSS-REFERENCE TO RELATED APPLICATIONS

This application claims priority to U.S. Provisional Application No. 61/098,299 filed on Sep. 19, 2008, and is hereby incorporated by reference in its entirety.

FIELD OF THE INVENTION

The present invention is related to dual functionality polymers, such as biopolymers, including both amphoteric polymers, alkoxylated cationic polymers and alkoxylated amphoteric polymers, that are useful as an ingredient to a variety of consumer products. More particularly, the polymers of the present invention provide soil release and cleaning benefits in fabric care products and other applications where soil removal on a surface is needed.

BACKGROUND OF THE INVENTION

Improved removal of soils and stains is a constant aim for laundry detergent manufacturers. In spite of the use of many effective surfactants and polymers, and combinations thereof, many surfactant-based products still do not achieve complete removal of greasy/oily stains, colored stains and particulate soils, especially when used at low water temperatures.

Fabric, especially clothing, can become soiled with a variety of foreign substances ranging from hydrophobic stains (grease, oil) to hydrophilic stains (clay). The level of cleaning which is necessary to remove these foreign substances depends to a large degree upon the amount of stain present and the degree to which the foreign substance has contacted the fabric fibers. For example, grass stains usually involve direct abrasive contact with vegetative matter thereby producing highly penetrating stains. Many cleaning formulations use combinations of enzymes to aid in the peptization and removal of these stains. Alternatively, clay soil stains, although in some instances contacting the fabric fibers with less force, nevertheless provide a different type of soil removal problem due to the high degree of charge associated with the clay itself. This high surface charge density resists any appreciable peptization and dispersal of the clay by conventional surfactants and enzymes. For these soils, peptizing polymers and builders aid in the removal of the soils. Finally, hydrophobic stains, such as greases and oils, usually involve another soil removal problem since technologies that remove grass stains and outdoor soil stains (clay) do not effectively aid in grease removal. For these hydrophobic stains, a surfactant or combination of surfactants is generally preferred for removal. For these reasons, an effective cleaning formulation is typically comprised of many technologies that aid in removal of a variety of soils. Unfortunately, due to cost and formulation constraints, it is rare to find a cleaning formulation that effectively incorporates each of the above cleaning technologies to completely remove all of the target soils and stains on fabrics or textiles.

Conventional soil release polymers are generally effective on polyester or other synthetic fabrics where the grease, oil or similar hydrophobic stains spread out and form an attached film and thereby are not easily removed in an aqueous laundering process. Many conventional soil release polymers have a less dramatic effect on "blended" fabrics, that is, on fabrics that comprise a mixture of cotton and synthetic material; and have little or no effect on cotton articles. One reason for the affinity of many soil release agents for synthetic fabric may be that the backbone of a conventional polyester soil release polymer typically comprises a mixture of terephthalate residues and ethyleneoxy or propyleneoxy polymeric units; the same materials that comprise the polyester fibers of certain synthetic fabric. This similar structure of soil release agents and synthetic fabric may produce an intrinsic affinity between these compounds.

There is a long felt need in the art for laundry detergent or fabric care compositions that contain soil release polymers ("SRP"), including polymers from natural renewable resources, that can effectively modify the fabric surface, such as cotton fabrics, to aid in the removal of many types of both hydrophilic and hydrophobic soils from fabric. In addition, as the effectiveness of the SRP increases there is less of a burden on the other cleaning technologies so that one could formulate the compositions using less of these other materials, use more cost effective materials and/or leverage improved cleaning to drive consumer noticeability.

SUMMARY OF THE INVENTION

The present disclosure relates to fabric care compositions comprising a soil release polymer comprising a randomly substituted linear or branched polymer backbone. Methods of making a fabric care composition and of treating a fabric are also disclosed. The present disclosure relates to polymers containing specific functional groups to drive soil release and cleaning on fabrics and various surfaces. The specific functional groups are derived from having alkoxy; nitrogen containing groups, such as amine and quaternary ammonium cation groups; and anionic substitution present with a degree of substitution (DS) from about 0.01 to about 2.0.

In particular, according to one embodiment, the present disclosure provides a fabric care composition comprising a soil release polymer comprising a randomly substituted linear or branched polymer backbone having a structure:

$$\text{-(monomer)-(monomer}\underset{\underset{(R)_p}{|}}{)}\text{-,}$$

wherein the randomly substituted polymer backbone comprises the residues of at least one unsubstituted monomer and at least one substituted monomer, wherein the residues of the monomers are independently selected from the group consisting of amino acid residues, furanose residues, pyranose residues and mixtures of any thereof, and the residues of the substituted monomers further comprise $—(R)_p$ substituent groups. Each R substituent group is independently selected from an anionic substituent and a nitrogen containing substituent; an alkoxy substituent and a nitrogen containing substituent; or an alkoxy substituent, an anionic substituent and a nitrogen containing substituent, where the anionic substituent has a degree of substitution of 0 or ranging from 0.1 to 2.0, the nitrogen containing substituent has a degree of substitution ranging from 0.001 to 0.05, the alkoxy substituent has a degree of substitution of 0 or ranging from 0.01 to 2.0, p is an integer with a value from 1 to 3, and wherein the soil release polymer has a weight average molecular weight ranging from 500 Daltons to 1,000,000 Daltons, provided that the degree of substitution of the anionic substituent and the alkoxy substituent cannot both be 0. The nitrogen containing substituent may be either an amine substituent that may be protonated under specific conditions or a quaternary ammonium cationic substituent.

According to another embodiment, the present disclosure provides fabric care compositions comprising a soil release polymer comprising a randomly substituted polysaccharide backbone comprising unsubstituted and substituted glucopyranose residues and having a general structure according to Formula I:

I

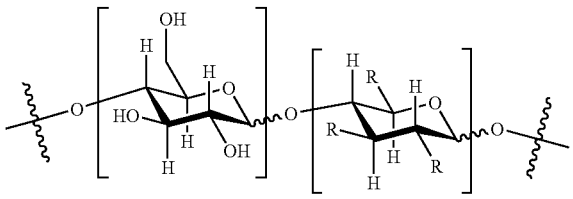

wherein each substituted glucopyranose residue independently comprises from 1 to 3 R substituents, which may be the same or different on each substituted glucopyranose residue. Each R substituent is independently a substituent selected from hydroxyl, hydroxymethyl, $R^1$, $R^2$, $R^3$ and a polysaccharide branch having a general structure according to Formula I; hydroxyl, hydroxymethyl, $R^1$, $R^2$ and a polysaccharide branch having a general structure according to Formula I; or hydroxyl, hydroxymethyl, $R^1$, $R^3$ and a polysaccharide branch having a general structure according to Formula I, provided that the at least one R substituent comprises at least one $R^1$ substituent and at least one $R^2$ substituent or comprises at least one $R^1$ substituent and at least one $R^3$ substituent. Each $R^1$ is independently, the same or different, a first substituent group having a degree of substitution ranging from 0.001 to 0.05 and a structure according to Formula II:

II

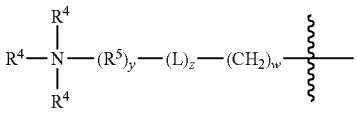

wherein each $R^4$ is a substituent selected from the group consisting of a lone pair of electrons; H; $CH_3$; linear or branched, saturated or unsaturated $C_2$-$C_{18}$ alkyl, provided that at least two of the $R^4$ groups are not a lone pair of electrons, $R^5$ is a linear or branched, saturated or unsaturated $C_2$-$C_{18}$ alkyl chain or a linear or branched, saturated or unsaturated secondary hydroxy($C_2$-$C_{18}$)alkyl chain, L is a linking group selected from the group consisting of —O—, —C(O)O—, —$NR^9$—, —C(O)$NR^9$—, and —$NR^9$C(O)$NR^9$—, and $R^9$ is H or $C_1$-$C_6$ alkyl, w has a value of 0 or 1, y has a value of 0 or 1, and z has a value of 0 or 1. Each $R^2$ is independently, the same or different, a second substituent group having a degree of substitution of 0 or ranging from 0.1 to 2.0 and a structure according to Formula III:

III

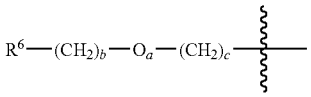

wherein $R^6$ is an anionic substituent selected from the group consisting of carboxylate, carboxymethyl, succinate, sulfate, sulfonate, arylsulfonate, phosphate, phosphonate, dicarboxylate, and polycarboxylate, a has a value of 0 or 1, b is an integer from 0 to 18, and c has a value of 0 or 1. Each $R^3$ is independently, the same or different, a third substituent group having a degree of substitution of 0 or ranging from 0.01 to 2.0, and having a structure according to Formula IV:

IV

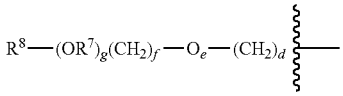

wherein d has a value of 0 or 1, e has a value of 0 or 1, f is an integer from 0 to 8, g is an integer from 0 to 50, each $R^7$ is the group ethylene, propylene, butylene, or mixtures thereof, and $R^8$ is an end group selected from the group consisting of hydrogen, $C_1$-$C_{20}$ alkyl, hydroxy, —$OR^1$ and —$OR^2$. The degree of substitution of the anionic substituent $R^2$ and the alkoxy substituent $R^3$ cannot both be 0. According to this embodiment, the soil release polymer has a weight average molecular weight ranging from 500 Daltons to 1,000,000 Daltons.

In yet another embodiment, the present disclosure provides methods for making a fabric care composition comprising adding a soil release polymer to the fabric care composition. The soil release polymer comprises a randomly substituted polysaccharide backbone comprising unsubstituted and substituted glucopyranose residues and having a general structure according to Formula I as described herein.

In a further embodiment, the present disclosure provides methods of treating a fabric comprising contacting the fabric with an effective amount of the fabric care composition comprising a soil release polymer comprising a randomly substituted polysaccharide backbone comprising unsubstituted and substituted glucopyranose residues and having a general structure according to Formula I. The various embodiments of the compositions and methods of the present disclosure are described in greater detail herein.

DETAILED DESCRIPTION OF THE INVENTION

Definitions

As used herein, the term "fabric care composition" includes, unless otherwise indicated, granular, powder, liquid, gel, paste, bar form and/or flake type laundry detergent agents, laundry soak or spray treatments and/or fabric treatment compositions. As used herein, the term "fabric treatment composition" includes, unless otherwise indicated, fabric softening compositions, fabric enhancing compositions, fabric freshening compositions and combinations there of. Such compositions may be, but need not be wash or rinse added compositions.

As used herein, the term "comprising" means various components conjointly employed in the preparation of the compositions of the present disclosure. Accordingly, the terms "consisting essentially of" and "consisting of" are embodied in the term "comprising".

As used herein, the articles including "the", "a" and "an" when used in a claim or in the specification, are understood to mean one or more of what is claimed or described.

As used herein, the terms "include", "includes" and "including" are meant to be non-limiting.

As used herein, the term "plurality" means more than one.

As used herein, the terms "residue", "monomer residue" and "residue of a monomer" when used with reference to the structure of a polymer mean the chemical structure of the monomer unit remaining after the monomer unit has been incorporated into the polymer chain by the polymerization reaction.

As used herein, the term "soil release" means the composition or polymer assists in the release of soil from the surface of a soiled object, such as a textile fiber surface. This may include modification, binding to, or coating at least a portion of a textile fiber surface with the composition or polymer to at least partially decrease the binding affinity or strength of the soil, stain or grease/oil compositions to the treated fabric surface, thereby aiding in the removal of the soil, stain or grease/oil from the fabric surface during the washing process. In addition, soil release includes release of soil absorbed into a textile fiber.

As used herein, the terms "fabric", "textile", and "cloth" are used non-specifically and may refer to any type of material, including natural and synthetic fibers, such as, but not limited to, cotton, polyester, nylon, silk and the like, including blends of various fabrics.

As used herein, the term "furanose" means a cyclic form of a monosaccharide having a 5-membered furan ring. As used herein, the term "pyranose" means a cyclic form of a monosaccharide having a 6-membered pyran ring. As used herein, the term "glucopyranose" means the cyclic form of glucose having a 6-membered pyran ring.

As used herein, the term "polysaccharide" means a polymer made primarily from saccharide monomer units, for example, but not limited to cyclic saccharide (i.e., furanose and pyranose) monomer units.

As used herein, the term "cellulose" means a polyglucopyranose polymer wherein the glucopyranose residues are connected by $\beta(1\rightarrow4)$ glycosidic linkages and containing about 7,000 to about 15,000 glucose units. As used herein, the term "hemicellulose" includes a heteropolysaccharide obtained primarily from cell walls and contains xylose, mannose, galactose, rhamnose and arabinose residues, along with glucose residues and other monomeric sugar derived residues, connected in chains of around 200 saccharide units. As used herein, the term "starch" includes various polyglucopyranose polymers wherein the glucopyranose residues are connected by $\alpha(1\rightarrow4)$ glycosidic linkages. Starch can comprise amylose and amylopectin. As used herein, the term "amylose" includes unbranched polyglucopyranose polymers wherein the glucopyranose residues are connected by $\alpha(1\rightarrow4)$ glycosidic linkages and containing from about 300 to 10,000 glucose units. As used herein, the term "amylopectin" includes branched polyglucopyranose polymers wherein the glucopyranose residues are connected by $\alpha(1\rightarrow4)$ glycosidic linkages with polyglucose branches connected by $\alpha(1\rightarrow6)$ glycosidic linkages occurring approximately every 24 to 30 glucose unit and containing from about 2,000 to 200,000 glucose units.

As used herein, the term "randomly substituted" means the substituents on the monomer residues in the randomly substituted polymer occur in a non-repeating or random fashion. That is, the substitution on a substituted monomer residue may be the same or different (i.e., substituents (which may be the same or different) on different atoms on the monomer residues) from the substitution on a second substituted monomer residue in a polymer, such that the overall substitution on the polymer has no pattern. Further, the substituted monomer residues occur randomly within the polymer (i.e., there is no pattern with the substituted and unsubstituted monomer residues within the polymer).

As used herein, the "degree of substitution" of soil release polymer is an average measure of the number of hydroxyl groups on each monomeric unit which are derivatized by substituent groups. For example, in polyglucan biopolymers, such as starch and cellulose, since each anhydroglucose unit has three potential hydroxyl groups available for substitution, the maximum possible degree of substitution is 3. The degree of substitution is expressed as the number of moles of substituent groups per mole of anhydroglucose unit, on a molar average basis. There are number of ways to determine degree of substitution of the soil release polymers. The methods used will depend on the type of substituent on polymer. The degree of substitution can be determined, for example, using proton nuclear magnetic resonance spectroscopy ("$^1$H NMR") methods well-known in the art. Suitable $^1$H NMR techniques include those described in "Observation on NMR Spectra of Starches in Dimethyl Sulfoxide, Iodine-Complexing, and Solvating in Water-Dimethyl Sulfoxide", Qin-Ji Peng and Arthur S. Perlin, *Carbohydrate Research,* 160 (1987), 57-72; and "An Approach to the Structural Analysis of Oligosaccharides by NMR Spectroscopy", J. Howard Bradbury and J. Grant Collins, *Carbohydrate Research,* 71, (1979), 15-25.

As used herein, the term "average molecular weight" refers to the average molecular weight of the polymer chains in a polymer composition. Average molecular weight may be calculated as either the weight average molecular weight ("$M_w$") or the number average molecular weight ("$M_n$"). Weight average molecular weight may be calculated using the equation:

$$M_w=(\Sigma_i N_i M_i^2)/(\Sigma_i N_i M_i)$$

where $N_i$ is the number of molecules having molecular weight $M_i$. Number average molecular weight may be calculated using the equation:

$$M_n=(\Sigma_i N_i M_i)/(\Sigma_i N_i).$$

The weight average molecular weight may be measured according to a gel permeation chromatography ("GPC") method described in U.S. Application Publication No. 2003/0154883 A1, entitled "Non-Thermoplastic Starch Fibers and Starch Composition for Making Same." In one embodiment of the invention, starch based biopolymers may be hydrolyzed to reduce the molecular weight of such starch components. The degree of hydrolysis may be measured by Water Fluidity ("WF"), which is a measure of the solution viscosity of the gelatinized starch.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Soil Release Polymer

The present disclosure relates to fabric care compositions comprising a soil release polymer comprising a randomly substituted linear or branched polymer backbone, such as a polysaccharide or polypeptide backbone. Methods of making a fabric care composition and of treating a fabric are also disclosed. The present disclosure relates to polymers containing specific functional groups to drive soil release and cleaning of fabrics and various surfaces.

Producing an oligomeric or polymeric material that mimics the structure of cotton or other natural fiber has not resulted in an effective soil release polymer. Although cotton and synthetic polyester fabric are both comprised of long chain polymeric materials, they are chemically very different. Cotton is comprised of cellulose fibers that consist of anhydroglucose units joined by (1→4) glycosidic linkages. These glycosidic linkages characterize the cotton cellulose as a polysaccharide whereas polyester soil release polymers are generally a combination of terephthalate and ethylene/propylene oxide residues. These differences in composition may account for the difference in the fabric properties of cotton versus polyester fabric. For example, cotton may be hydrophilic relative to polyester, whereas polyester is hydrophobic and attracts oily or greasy dirt and can easily be "dry cleaned". Importantly, the terephthalate and ethyleneoxy/propyleneoxy backbone of polyester fabric does not contain reactive sites, such as the hydroxyl moieties of cotton, which react with stains in different manner than synthetics. Thus, many cotton stains become "fixed" and can only be resolved by bleaching the fabric. While not intending to be limited by any particular theory, the present disclosure provides for effective soil release polymers that may deposit on, bind to, or coat at least a portion of a textile fiber surface with the composition or soil release polymer to at least partially decrease the binding affinity or strength of the soil, stain or grease/oil compositions to the fabric surface, thereby aiding in the removal of the soil, stain or grease/oil from the treated fabric surface during the washing process and subsequent washing processes.

According to one embodiment, the soil release polymers may comprise a randomly substituted linear or branched polymer backbone having a structure:

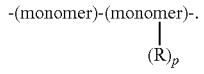

wherein the randomly substituted polymer backbone comprises the residues of at least one unsubstituted monomer and at least one substituted monomer. According to certain embodiments, the residues of the substituted and unsubstituted monomers may be selected from amino acid residues, furanose residues, pyranose residues, and mixtures of any thereof. The residue of the substituted monomer may comprise —$(R)_p$ substituent groups. According to certain embodiments, p is an integer from 1 to 3. That is, each at least one, and in specific embodiments a plurality of the residues of the monomer may be substituted monomer residues having 1, 2, or 3 substituent groups R attached to the monomer residue. According to these embodiments, the randomly substituted polymer backbone must comprise at least one substituted monomer residue.

According to these embodiments, the polymer is randomly substituted and may be linear or branched and each R residue on the various substituted monomer residues may be independently selected from an anionic substituent and a nitrogen containing substituent; an alkoxy substituent and a nitrogen containing substituent; or an alkoxy substituent, an anionic substituent, and a nitrogen containing substituent. That is, according to one embodiment, the soil release polymer may comprise R groups selected from an anionic substituent and a nitrogen containing substituent; while in another embodiment the soil release polymer may comprise R groups selected from an alkoxy substituent and a nitrogen containing substituent, and in still another embodiment the soil release polymer may comprise R groups selected from an alkoxy substituent, an anionic substituent, and a nitrogen containing substituent. According to these embodiments, the soil release polymer substitution may include a nitrogen containing substituent an at least one of an alkoxy substituent or an anionic substituent. In other embodiments, the soil release polymer may include nitrogen containing substituents, anionic substituents, and alkoxy substituents. Various suitable structures for the alkoxy substituent, the anionic substituent, and the nitrogen containing substituent are described in detail herein. As used herein, the term "nitrogen containing substituents" include both quaternary ammonium cationic substituents and anime substituents (i.e., primary, secondary, and tertiary amine substituents) that may form ammonium cationic substituents after protonation, for example, under at least mildly acidic conditions.

In certain embodiments of the fabric care composition, the randomly substituted polymer backbone may be a randomly substituted polysaccharide backbone. For example, in specific embodiments, the randomly substituted polysaccharide backbone may be a randomly substituted polyglucose backbone, such that the residue of the monomer is an unsubstituted glucopyranose residue or a substituted glucopyranose residue. Examples of randomly substituted polyglucose backbones include, but are not limited to, randomly substituted cellulose backbones, randomly substituted hemicellulose backbone, randomly substituted starch backbones (such as a randomly substituted amylose backbone or a randomly substituted amylopectin backbone, or mixtures thereof), and blends of any thereof. For example, when the polyglucose backbone is a randomly substituted hemicellulose backbone, the backbone may further comprise one or more non-glycopyranose saccharide residues, such as, but not limited to xylose, mannose, galactose, rhamnose and arabinose residues.

According to various embodiments of the fabric care composition, the composition may further comprise one or more additional adjuncts. Suitable adjuncts include, but are not limited to, bleach activators, surfactants, builders, chelating agents, dye transfer inhibiting agents, dispersants, enzymes, enzyme stabilizers, catalytic metal complexes, polymeric dispersing agents, clay and soil removal/anti-redeposition agents, brighteners, suds suppressors, dyes, perfumes, perfume delivery systems, structure elasticizing agents, fabric softeners, carriers, hydrotropes, processing aids, pigments, and various combinations of any thereof. According to certain embodiments, the fabric care composition may be a liquid laundry detergent (including, for example, a heavy duty liquid ("HDL") laundry detergent), a solid laundry detergent, a laundry soap product, or a laundry spray treatment product. In addition, the soil release polymer described according to the various embodiments herein, may be included in any fabric care formulation or other formulation in which soil release and anti-redeposition are desired.

According to specific embodiments, the present disclosure provides for a fabric care composition comprising a soil release polymer comprising a randomly substituted polysaccharide backbone comprising unsubstituted and substituted glucopyranose residues and having a general structure according to Formula I, below:

I

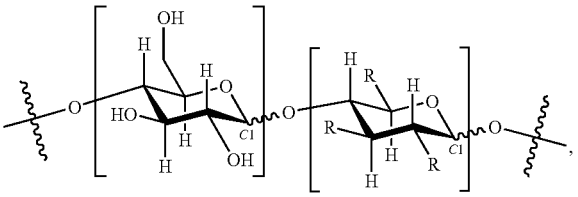

where the stereochemistry at the C1 anomeric carbon is determined, at least in part, by the source of the polysaccharide. As discussed herein, the randomly substituted polysaccharide backbone may be a randomly substituted cellulose backbone or a randomly substituted starch backbone. As discussed herein, the randomly substituted polysaccharide backbone may be a randomly substituted cellulose backbone (i.e., C1 stereochemistry is β) or a randomly substituted starch backbone (i.e., C1 stereochemistry is α). According to those embodiments where the polysaccharide is a randomly substituted cellulose backbone, the randomly substituted cellulose backbone may have a general structure according to Formula IA:

IA

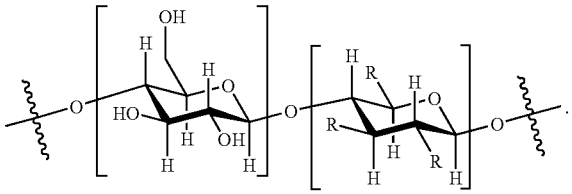

According to those embodiments where the polysaccharide is a randomly substituted starch backbone, the randomly substituted starch backbone may have a general structure according to Formula IB:

IB

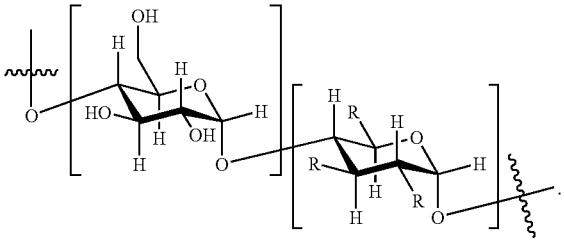

It should be noted for any of Formulae I, IA, or IB, that the structural representation depicted herein is not meant to infer any arrangement of the substituted or unsubstituted glucopyranose residues or any ratio of substituted or unsubstituted glucopyranose residues.

In these embodiments, the polysaccharide backbone, such as, the cellulose, the hemicellulose or the starch backbone, has been chemically modified to include one or more substituents on the substituted glucopyranose residues. Certain reactions suitable for modifying the starch are described in the Examples section.

Referring to any of Formulae I, IA, or IB, each substituted glucopyranose residue may independently comprise from 1 to 3-R substituents, which may be the same or different on each substituted glucopyranose residue. That is, the number and type of substituent on a substituted glucopyranose residue may be the same as or different from the other substituted glucopyranose residues in the polymer backbone. For example, and not to imply any particular preferred substitution pattern, one substituted glucopyranose residue may have a substituent on the C2 carbon, such as an alkoxy substituent, whereas another substituted glucopyranose residue in the polysaccharide may be unsubstituted at the C2 carbon, but have a nitrogen containing substituent at the C3 carbon and an anionic substituent at the C6 carbon.

According to one embodiment, the R substituents in any of Formulae I, IA, or IB may each be independently a substituent selected from hydroxyl, hydroxymethyl, $R^1$, $R^2$, $R^3$, and a polysaccharide branch having a general structure according to Formulae I, IA, or IB, provided that at least one of the R substituents on the substituted glucopyranose residue is $R^1$, $R^2$, or $R^3$. In specific compositions, a plurality of R substituents are $R^1$, $R^2$, and $R^3$. In another embodiment, the R substituents in any of Formulae I, IA, or IB may each be independently a substituent selected from hydroxyl, hydroxymethyl, $R^1$, $R^2$, and a polysaccharide branch having a general structure according to Formulae I, IA, or IB, provided that at least one of the R substituents on the substituted glucopyranose residue is $R^1$ or $R^2$. In specific compositions a plurality of R substituents are $R^1$ and $R^2$. In another embodiment, the R substituents in any of Formulae I, IA, or IB may each be independently a substituent selected from hydroxyl, hydroxymethyl, $R^1$, $R^3$, and a polysaccharide branch having a general structure according to Formulae I, IA, or IB, provided that at least one of the R substituents on the substituted glucopyranose residue is $R^1$ or $R^3$. In specific compositions a plurality of R substituents are $R^1$ and $R^3$. In those embodiments where the R substituent is a polysaccharide branch, the polysaccharide branch may be bonded to the polysaccharide backbone by a glycosidic bond formed by reaction of a hydroxyl group on a substituted glucopyranose residue in the backbone and a C1 anomeric carbon of the polysaccharide branch, such as, for example, an α or β(1→2) glycosidic bond, an α or β(1→3) glycosidic bond or an α or β(1→6) glycosidic bond.

In those embodiments wherein the R substituent is an $R^1$ substituent, $R^1$ may be a quaternary ammonium cationic substituent or an amine substituent that becomes cationic in mildly acidic environments (such as a primary, secondary, or tertiary amine containing substituent). For example, according to these embodiments, each $R^1$ may independently be, the same or different, a first substituent group having a structure according to Formula II:

II

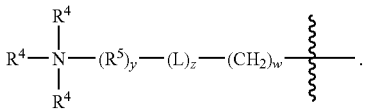

According to these embodiments, each $R^4$ is a substituent selected from a lone pair of electrons; H; $CH_3$; or a linear or branched, saturated or unsaturated $C_2$-$C_{18}$ alkyl. According to certain embodiments of the $R^1$ group, at least two of the $R^4$ groups of Formula II must not be a lone pair of electrons. That is, in these embodiments, one $R^4$ group may be a lone pair of electrons such that the nitrogen containing end group in Formula II is an amine group under neutral or basic conditions. It will be understood by one skilled in the art that the amine group may be protonated under acidic conditions to provide an ammonium cationic charge. According to other embodiments of the $R^1$ group, no $R^4$ group is a lone pair of electrons, such that the nitrogen containing end group in Formula II is a quaternary ammonium cation. Referring still to Formula II, $R^5$ may be a linear or branched, saturated or unsaturated $C_2$-$C_{18}$ alkyl chain or a linear or branched, saturated or unsaturated secondary hydroxy($C_2$-$C_{18}$)alkyl chain. In various embodiments, the group L is a linking group selected from —O—, —C(═O)O—, —OC(═O)—, —$NR^9$—, —C(═O)$NR^9$—, —$NR^9$C(═O)—, and —$NR^9$C(═O)$NR^9$—, where $R^9$ is H, or $C_1$-$C_6$ alkyl. According to the various embodiments, w may have a value of 0 or 1, y may have a value of 0 or 1, and z may have a value of 0 or 1.

According to certain embodiments of the soil release polysaccharide where the R substituent may comprise an $R^1$ first substituent group, the $R^1$ first substituent may have a degree of substitution ranging from 0.001 to 0.05. In other embodiments, the $R^1$ first substituent may have a degree of substitution ranging from 0.001 to 0.01.

In those embodiments wherein the R substituent is an $R^2$ substituent, $R^2$ may be an anionic substituent. For example, according to these embodiments, each $R^2$ may be independently, the same or different, a second substituent group having a structure according to Formula III:

III

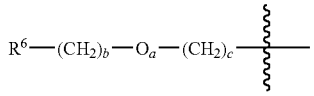

According to these embodiments, each $R^6$ may be an anionic substituent selected from a carboxylate (—$COO^-$), carboxymethyl (—$CH_2COO^-$), succinate (—$OOCCH_2CH_2COO^-$), sulfate (—$OS(O_2)O^-$), sulfonate (—$S(O_2)O^-$), arylsulfonate (—Ar—$S(O_2)O^-$, where Ar is an aryl ring), phosphate (—$OPO_2(OR')^-$ or —$OPO_3^{2-}$, where R' is a H, alkyl, or aryl), phosphonate (—$PO_2(OR')^-$ or $PO_3^{2-}$, where R' is a H, alkyl, or aryl), dicarboxylate (—$Y(COO^-)_2$, where Y is alkyl or aryl), or polycarboxylate (—$Y(COO^-)_t$, where Y is alkyl or aryl and t is greater than 2). According to the various embodiments, a may have a value of 0 or 1, b is an integer having a value from 0 to 18, and c may have a value of 0 or 1.

According to certain embodiments of the soil release polysaccharide where the R substituent may comprise a second substituent group $R^2$, the $R^2$ second substituent may have a degree of substitution of 0 or ranging from 0.1 to 2.0. In other embodiments, the $R^2$ second substituent may have a degree of substitution ranging from 0.1 to 2.0. In other embodiments, the $R^2$ second substituent may have a degree of substitution ranging from 0.5 to 1.5. In those embodiments where the degree of substitution of $R^2$ is 0, the degree of substitution of $R^3$ cannot also be 0.

In those embodiments wherein the R substituent is an $R^3$ substituent, $R^3$ may be an alkoxy substituent. For example, according to these embodiments, each $R^3$ may be independently, the same or different, a third substituent group having a structure according to Formula IV:

IV

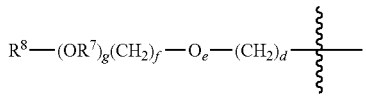

According to these embodiments, each $R^7$ may be a group selected from ethylene, propylene, butylene, or mixtures thereof. In certain embodiments, the structure of ($OR^7$) may be a polyethylene oxide group, a polypropylene oxide group, a polybutylene oxide group or mixtures thereof. In specific embodiments, ($OR^7$) may have a structure —O—CH($R^{10}$)$CH_2$—, where $R^{10}$ is methyl or ethyl (i.e., polypropylene oxide and polybutylene oxide, respectively). The structure "$OR^7$" includes structures where an oxygen is between $R^7$ and $R^8$ and structures where an oxygen is between $R^7$ and $(CH_2)_f$. Each $R^8$ group may be an end group selected from hydrogen, $C_1$-$C_{20}$ alkyl (which may be branched or unbranched, and saturated or unsaturated), hydroxy, —$OR^1$, or —$OR^2$ (where $R^1$ and $R^2$ are as described herein). According to the various embodiments, d may have a value of 0 or 1, e may have a value of 0 or 1, f is an integer having a value from 0 to 8, and g is an integer having a value from 0 to 50.

According to certain embodiments of the soil release polysaccharide where the R substituent may comprise an $R^3$ third substituent group, the $R^3$ third substituent may have a degree of substitution of 0 or ranging from 0.01 to 2.0. In other embodiments, the $R^3$ third substituent may have a degree of substitution ranging from 0.01 to 2.0. In other embodiments, the $R^3$ third substituent may have a degree of substitution ranging from 0.2 to 1.5. As noted herein, in certain embodiments the degree of substitution of either $R^2$ or $R^3$ may be 0. However, in those embodiments where the degree of one of $R^2$ or $R^3$ is 0, then the degree of substitution of the other substituent (i.e., either $R^3$ or $R^2$, respectively) cannot also be 0. That is, the degree of substitution of both $R^2$ and $R^3$ cannot both be 0. For example, in those embodiments where the degree of substitution of $R^2$ is 0, then the degree of substitution of $R^3$ cannot also be 0. Likewise, in those embodiments where the degree of substitution of $R^3$ is 0, then the degree of substitution of $R^2$ cannot also be 0.

According to various embodiments described herein, the soil release polymer may have a weight average molecular weight ranging from 500 Daltons to 1,000,000 Daltons. In other embodiments, the soil release polymers described herein may have a weight average molecular weight ranging from 5,000 Daltons to 1,000,000 Daltons, or even 50,000 Daltons to 200,000 Daltons.

In various embodiments of the randomly substituted polysaccharide, the polysaccharide backbone may be a randomly substituted starch backbone where the starch comprises amylose and/or amylopectin. Suitable sources of starch that may be chemically modified to produce the soil release polymers described herein include corn starch, wheat starch, rice starch, waxy corn starch, oat starch, cassava starch, waxy barley starch, waxy rice starch, glutenous rice starch, sweet rice starch, potato starch, tapioca starch, sago starch, high amylose starch and mixtures of any thereof. While specific starch sources are recited herein, it is contemplated by the inventors that any source of cellulose, hemicellulose, or starch would be suited to form the randomly substituted polysaccharide soil release polymers described herein. Other modified polysaccharides are within the scope of the present disclosure.

In specific embodiments of the fabric care compositions, the randomly substituted starch backbone may be derived from a high amylose starch. For example, in one embodiment the high amylose starch may have an amylose content ranging from about 20% to about 90% by weight of the total modified polysaccharide. In another embodiment, the high amylose starch may have an amylose content ranging from about 50% to about 85% by weight. In still another embodiment, the high amylose starch may have an amylose content ranging from about 50% to about 70% by weight. According to these embodiments, at least a portion of the remaining starch may be derived from amylopectin. A suitable technique for measuring percentage amylose by weight of the starch include the methods described by the following: "Determination of Amylose in Cereal and Non-Cereal Starches by a Colorimetric Assay: Collaborative Study," C. Martinez and J. Prodolliet, *Starch,* 48 (1996), 81-85; and "An Improved Colorimetric Procedure for Determining Apparent and Total Amylose in Cereal and Other Starches", W. R. Morrison and B. Laignelet, *Journal Of Cereal Science,* 1 (1983).

In other embodiments, the fabric care compositions may comprise a soil release polymer that comprises a randomly substituted starch backbone that comprises a randomly substituted amylopectin backbone. According to these embodiments, the amylopectin backbone may comprise at least one $\alpha(1\rightarrow6)$ polyglucopyranose branch where a hydroxyl group at the C6 position on a glucopyranose monomer residue on the starch backbone has reacted to form a glycosidic bond with a C1 carbon of a polyglucopyranose branch which comprises unsubstituted and substituted glucopyranose residues. The polyglucopyranose branch may have a structure according to Formula I, IA, or IB. In other embodiments, the amylopectin back bone may comprise a plurality of $\alpha(1\rightarrow6)$ polyglucopyranose branches occurring at approximately every 24 to 30 glucopyranose residues in the amylopectin starch backbone.

In one embodiment of the present disclosure, the modified starch based biopolymers may be hydrolyzed to reduce the molecular weight of such starch components. The degree of hydrolysis may be measured by Water Fluidity ("WF"), which is a measure of the solution viscosity of the gelatinized starch. One suitable method for determining WF is described at columns 8-9 of U.S. Pat. No. 4,499,116. One skilled in the art will readily appreciate that starch biopolymers that have a relatively high degree of hydrolysis will have low solution viscosity or a high water fluidity value. According to one embodiment, the modified starch based biopolymer may comprise a viscosity having a WF value from about 40 to about 84. Suitable methods of hydrolyzing starch include, but are not limited to, those described by U.S. Pat. No. 4,499,116, with specific mention to column 4.

In other embodiments of the fabric care compositions, the polysaccharide backbone may be a randomly substituted hemicellulose backbone. The randomly substituted hemicellulose backbone may comprise at least one unsubstituted or substituted carbohydrate residue, such as, for example, an unsubstituted or substituted xylose residue, an unsubstituted or substituted mannose residue, an unsubstituted or substituted galactose residue, an unsubstituted or substituted rhamnose residue, an unsubstituted or substituted arabinose residue, and combinations of any thereof. According to certain embodiments, the substituted carbohydrate residue comprises at least one $R^1$ substituent, at least one $R^2$ substituent, or at least one $R^3$ substituent.

The soil release polymers according to the various embodiments described herein may be incorporated into the cleaning composition in an amount necessary to provide the improved soil release characteristics for the fabric care composition. In certain embodiments, the soil release polymers may comprise from 0.1% to 20.0% by weight of the fabric care composition. In other embodiments, the soil release polymers may comprise from 0.1% to 10.0% by weight of the fabric care composition. In still other embodiments, the soil release polymers may comprise from 0.5% to 5.0% by weight of the fabric care composition.

Fabric Care Compositions

Still further embodiments of the present disclosure provide methods of making fabric care compositions. According to specific embodiments, the methods may comprise the steps of adding a soil release polymer to the fabric care composition. The soil release polymer may comprise a randomly substituted polymer such as a randomly substituted polysaccharide backbone as described in detail herein. In certain embodiments, the method may further comprise adding at least one or more adjuncts, such as a bleach activator, a surfactant, a builder, a chelating agent, a dye transfer inhibiting agent, a dispersant, an enzyme, an enzyme stabilizer, a catalytic metal complex, a polymeric dispersing agent, a clay and soil removal/anti-redeposition agent, a brightener, a suds suppressor, a dye, a perfume, a perfume delivery system, a structure elasticizing agent, a fabric softener, a carrier, a hydrotrope, a processing aid, a pigments, and combinations of any thereof, to the fabric care composition.

Still other embodiments of the present disclosure provide for methods of treating a fabric comprising contacting the fabric with an effective amount of the fabric care composition as described herein. Contacting the fabric may be as a pretreatment or contacting during a cleaning process, such as, during a wash cycle or rinse cycle.

In one aspect, the fabric care compositions disclosed herein, may take the form of liquid laundry detergent compositions. In one aspect, such compositions may be a heavy duty liquid ("HDL") composition. Such compositions may comprise a sufficient amount of a surfactant to provide the desired level of one or more cleaning or soil release properties, typically by weight of the total composition, from about 5% to about 90%, from about 5% to about 70% or even from about 5% to about 40%; and the soil release polymer of the present disclosure, to provide a soil and/or stain release benefit to fabric washed in a solution containing the detergent. Typically the detergent is used in the wash solution at a level of from about 0.0001% to about 0.05%, or even from about 0.001% to about 0.01% by weight of the wash solution.

The liquid care compositions may additionally comprise an aqueous, non-surface active liquid carrier. Generally, the amount of the aqueous, non-surface active liquid carrier employed in the compositions herein will be effective to solubilize, suspend or disperse the composition components. For example, the compositions may comprise, by weight, from about 5% to about 90%, from about 10% to about 70%, or even from about 20% to about 70% of an aqueous, non-surface active liquid carrier.

The most cost effective type of aqueous, non-surface active liquid carrier may be water. Accordingly, the aqueous, non-surface active liquid carrier component may be generally mostly, if not completely, water. While other types of water-miscible liquids, such alkanols, diols, other polyols, ethers, amines, and the like, have been conventionally added to liquid detergent compositions as co-solvents or stabilizers, in certain embodiments of the present disclosure, the utilization of such water-miscible liquids may be minimized to hold down composition cost. Accordingly, the aqueous liquid carrier component of the liquid detergent products herein will generally comprise water present in concentrations ranging from about 5% to about 90%, or even from about 20% to about 70%, by weight of the composition.

The liquid detergent or fabric care compositions herein may take the form of an aqueous solution or uniform dispersion or suspension of surfactant, the soil release polymer, as described herein, and certain optional adjunct ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable and will typically have a viscosity which ranges from about 100 to 600 cps, more preferably from about 150 to 400 cps. For purposes of this disclosure, viscosity may be measured with a Brookfield LVDV-II+ viscometer apparatus using a #21 spindle.

Suitable surfactants may be anionic, nonionic, cationic, zwitterionic and/or amphoteric surfactants. In one aspect, the detergent composition comprises anionic surfactant, nonionic surfactant, or mixtures thereof.

Suitable anionic surfactants may be any of the conventional anionic surfactant types typically used in liquid detergent products. Such surfactants include the alkyl benzene sulfonic acids and their salts as well as alkoxylated or non-alkoxylated alkyl sulfate materials. Exemplary anionic surfactants are the alkali metal salts of $C_{10}$-$C_{16}$ alkyl benzene sulfonic acids, preferably $C_{11}$-$C_{14}$ alkyl benzene sulfonic acids. In one aspect, the alkyl group is linear. Such linear alkyl benzene sulfonates are known as "LAS". Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$, e.g., $C_{12}$ LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: $R'—O—(C_2H_4O)_n—SO_3M$ wherein R' is a $C_8$-$C_{20}$ alkyl group, n is from about 1 to 20, and M is a salt-forming cation. In a specific embodiment, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6, and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this disclosure and used as or in any anionic surfactant component which may be present. Specific examples of non-alkoxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $R''OSO_3^-M^+$ wherein R" is typically a linear $C_8$-$C_{20}$ hydrocarbyl group, which may be straight chain or branched chain, and M is a water-solubilizing cation. In specific embodiments, R" is a $C_{10}$-$C_{15}$ alkyl, and M is alkali metal, more specifically R" is $C_{12}$-$C_{14}$ and M is sodium.

Specific, non-limiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3)-alkyl sulfates having formulae (V) and (VI):

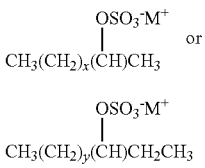

(V)

or (VI)

wherein M in formulae (V) and (VI) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$-$C_{18}$ alkyl alkoxy sulfates ($AE_xS$) wherein preferably x is from 1-30; e) $C_{10}$-$C_{18}$ alkyl alkoxy carboxylates preferably comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548.; i) methyl ester sulfonate (MES); and j) alpha-olefin sulfonate (AOS).

Suitable nonionic surfactants useful herein can comprise any of the conventional nonionic surfactant types typically used in liquid detergent products. These include alkoxylated fatty alcohols and amine oxide surfactants. Preferred for use in the liquid detergent products herein are those nonionic surfactants which are normally liquid. Suitable nonionic surfactants for use herein include the alcohol alkoxylate nonionic surfactants. Alcohol alkoxylates are materials which correspond to the general formula: $R^{11}(C_mH_{2m}O)_nOH$ wherein $R^{11}$ is a $C_8$-$C_{16}$ alkyl group, m is from 2 to 4, and n ranges from about 2 to 12. Preferably $R^{11}$ is an alkyl group, which may be primary or secondary, which contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradename NEODOL® by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R'''(EO)_x(PO)_y(BO)_zN(O)(CH_2R')_2.qH_2O$. In this formula, R''' is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety, preferably selected from hydrogen, methyl and $—CH_2OH$. When x+y+z is different from 0, EO is ethyleneoxy, PO is propyleneneoxy and BO is butyleneoxy. Amine oxide surfactants are illustrated by $C_{12}$-$C_{14}$ alkyldimethyl amine oxide.

Non-limiting examples of nonionic surfactants include: a) $C_{12}$-$C_{18}$ alkyl ethoxylates, such as, NEODOL® nonionic surfactants; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols, BA, as discussed in U.S. Pat. No. 6,150,322; e) $C_{14}$-$C_{22}$ mid-chain branched alkyl alkoxylates, $BAE_x$, wherein x is 1-30, as discussed in U.S. Pat. Nos.

6,153,577; 6,020,303; and 6,093,856; f) alkylpolysaccharides as discussed in U.S. Pat. No. 4,565,647; specifically alkylpolyglycosides as discussed in U.S. Pat. Nos. 4,483,780 and 4,483,779; g) polyhydroxy fatty acid amides as discussed in U.S. Pat. No. 5,332,528; WO 92/06162; WO 93/19146; WO 93/19038; and WO 94/09099; and h) ether capped poly (oxyalkylated) alcohol surfactants as discussed in U.S. Pat. No. 6,482,994 and WO 01/42408.

In the laundry detergent compositions herein, the detersive surfactant component may comprise combinations of anionic and nonionic surfactant materials. When this is the case, the weight ratio of anionic to nonionic will typically range from 10:90 to 90:10, more typically from 30:70 to 70:30.

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002; WO 98/35003; WO 98/35004; WO 98/35005; and WO 98/35006; d) cationic ester surfactants as discussed in U.S. Pat. Nos. 4,228,042; 4,239,660; 4,260,529; and 6,022,844; and e) amino surfactants as discussed in U.S. Pat. No. 6,221,825 and WO 00/47708, specifically amido propyldimethyl amine (APA).

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaine, including alkyl dimethyl betaine and cocodimethyl amidopropyl betaine, $C_8$-$C_{18}$ (preferably $C_{12}$-$C_{18}$)amine oxides and sulfo and hydroxy betaines, such as N-alkyl-N,N-dimethylammino-1-propane sulfonate where the alkyl group can be $C_8$-$C_{18}$, preferably $C_{10}$-$C_{14}$.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 at column 19, lines 18-35, for examples of ampholytic surfactants.

In another aspect of the present disclosure, the fabric care compositions disclosed herein, may take the form of granular laundry detergent compositions. Such compositions comprise the soil release polymer of the present disclosure to provide soil and stain removal benefits to fabric washed in a solution containing the detergent. Typically, the granular laundry detergent compositions are used in washing solutions at a level of from about 0.0001% to about 0.05%, or even from about 0.001% to about 0.01% by weight of the washing solution.

Granular detergent compositions of the present disclosure may include any number of conventional detergent ingredients. For example, the surfactant system of the detergent composition may include anionic, nonionic, zwitterionic, ampholytic and cationic classes and compatible mixtures thereof. Detergent surfactants for granular compositions are described in U.S. Pat. Nos. 3,664,961 and 3,919,678. Cationic surfactants include those described in U.S. Pat. Nos. 4,222,905 and 4,239,659.

Non-limiting examples of surfactant systems include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3)-alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$-$C_{18}$ alkyl alkoxy sulfates ("$AE_xS$"; especially EO 1-7 ethoxy sulfates), $C_{10}$-$C_{18}$ alkyl alkoxy carboxylates (especially the EO 1-5 ethoxycarboxylates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the so-called narrow peaked alkyl ethoxylates and $C_6$-$C_{12}$ alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like, can also be included in the surfactant system. The $C_{10}$-$C_{18}$ N-alkyl polyhydroxy fatty acid amides can also be used. See WO 92/06154. Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metals, especially sodium, salts of the above. Preferred for use herein are the phosphates, carbonates, silicates, $C_{10}$-$C_{18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane-1,1,2-triphosphonic acid. Other phosphorus builder compounds are disclosed in U.S. Pat. Nos. 3,159,581; 3,213,030; 3,422,021; 3,422,137; 3,400,176; and 3,400,148. Examples of non-phosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, non-phosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant. Other suitable polycarboxylates for use herein are the polyacetal carboxylates described in U.S. Pat. Nos. 4,144,226 and 4,246,495.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of this disclosure at levels of from about 2% to about 15% on an anhydrous weight basis. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537.

Bleaching agents and activators are described in U.S. Pat. Nos. 4,412,934 and 4,483,781. Chelating agents are also described in U.S. Pat. No. 4,663,071 from column 17, line 54 through column 18, line 68. Suds modifiers are also optional ingredients and are described in U.S. Pat. Nos. 3,933,672 and 4,136,045. Suitable smectite clays for use herein are described in U.S. Pat. No. 4,762,645 column 6, line 3 through column 7, line 24. Suitable additional detergency builders for use herein are enumerated in U.S. Pat. No. 3,936,537 at column 13, line 54 through column 16, line 16, and in U.S. Pat. No. 4,663,071.

In yet another aspect of the present disclosure, the fabric care compositions disclosed herein, may take the form of rinse added fabric conditioning compositions. Such compositions may comprise a fabric softening active and the soil release cleaning polymer of the present disclosure, to provide a stain repellency benefit to fabrics treated by the composition, typically from about 0.00001 wt. % (0.1 ppm) to about 1 wt. % (10,000 ppm), or even from about 0.0003 wt. % (3 ppm) to about 0.03 wt. % (300 ppm) based on total rinse added fabric conditioning composition weight. In another specific embodiment, the compositions are rinse added fabric conditioning compositions. Examples of typical rinse added conditioning composition can be found in U.S. Provisional Patent Application Ser. No. 60/687,582 filed on Oct. 8, 2004.

Adjunct Materials

While not essential for the purposes of the present disclosure, the non-limiting list of adjuncts illustrated hereinafter are suitable for use in the fabric care compositions and may be desirably incorporated in certain embodiments of the disclosure, for example to assist or enhance performance, for treatment of the substrate to be cleaned, or to modify the aesthetics of the composition as is the case with perfumes, colorants, dyes or the like. It is understood that such adjuncts are in addition to the components that were previously listed for any particular embodiment. The total amount of such adjuncts may range from about 0.1% to about 50%, or even from about 1% to about 30%, by weight of the fabric care composition.

The precise nature of these additional components, and levels of incorporation thereof, will depend on the physical form of the composition and the nature of the operation for which it is to be used. Suitable adjunct materials include, but are not limited to, polymers, for example cationic polymers, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282; 6,306,812; and 6,326,348.

As stated, the adjunct ingredients are not essential to the fabric care compositions. Thus, certain embodiments of the compositions do not contain one or more of the following adjuncts materials: bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. However, when one or more adjuncts are present, such one or more adjuncts may be present as detailed below:

Surfactants—The compositions according to the present disclosure can comprise a surfactant or surfactant system wherein the surfactant can be selected from nonionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

Builders—The compositions of the present disclosure can comprise one or more detergent builders or builder systems. When present, the compositions will typically comprise at least about 1% builder, or from about 5% or 10% to about 80%, 50%, or even 30% by weight, of said builder. Builders include, but are not limited to, the alkali metal, ammonium and alkanolammonium salts of polyphosphates, alkali metal silicates, alkaline earth and alkali metal carbonates, aluminosilicate builders polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Chelating Agents—The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

Dye Transfer Inhibiting Agents—The compositions of the present disclosure may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

Dispersants—The compositions of the present disclosure can also contain dispersants. Suitable water-soluble organic materials are the homo- or co-polymeric acids or their salts, in which the polycarboxylic acid may comprise at least two carboxyl radicals separated from each other by not more than two carbon atoms.

Enzymes—The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

Enzyme Stabilizers—Enzymes for use in compositions, for example, detergents can be stabilized by various techniques. The enzymes employed herein can be stabilized by the presence of water-soluble sources of calcium and/or magnesium ions in the finished compositions that provide such ions to the enzymes.

Catalytic Metal Complexes—The compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. Nos. 5,597,936 and 5,595,967. Such cobalt catalysts are readily prepared by known procedures, such as taught for example in U.S. Pat. Nos. 5,597,936, and 5,595,967.

Compositions herein may also suitably include a transition metal complex of a macropolycyclic rigid ligand ("MRL"). As a practical matter, and not by way of limitation, the compositions and cleaning processes herein can be adjusted to provide on the order of at least one part per hundred million of the benefit agent MRL species in the aqueous washing medium, and may provide from about 0.005 ppm to about 25 ppm, from about 0.05 ppm to about 10 ppm, or even from about 0.1 ppm to about 5 ppm, of the MRL in the wash liquor.

Preferred transition-metals in the instant transition-metal bleach catalyst include manganese, iron and chromium. Preferred MRLs herein are a special type of ultra-rigid ligand that is cross-bridged such as 5,12-diethyl-1,5,8,12-tetraazabicyclo[6.6.2]hexadecane. Suitable transition metal MRLs are readily prepared by known procedures, such as taught, for example, in WO 00/32601, and U.S. Pat. No. 6,225,464.

Processes of Making Fabric Care Compositions

The fabric care compositions of the present disclosure can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, e.g., non-ionic surfactant, the non-surface active liquid carriers and other optional liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

In another aspect of producing liquid detergents, the soil release polymer is first combined with one or more liquid components to form a soil release polymer premix, and this soil release polymer premix is added to a composition formulation containing a substantial portion, for example more than 50% by weight, more than 70% by weight, or even more than 90% by weight, of the balance of components of the laundry detergent composition. For example, in the methodology described above, both the soil release polymer premix and the enzyme component are added at a final stage of component additions. In another aspect, the soil release polymer is encapsulated prior to addition to the detergent composition, the encapsulated polymer is suspended in a structured liquid, and the suspension is added to a composition formulation containing a substantial portion of the balance of components of the laundry detergent composition.

Various techniques for forming detergent compositions in such solid forms are well known in the art and may be used herein. In one aspect, when the fabric care composition is in the form of a granular particle, the soil release polymer is provided in particulate form, optionally including additional but not all components of the laundry detergent composition. The soil release polymer particulate is combined with one or more additional particulates containing a balance of components of the laundry detergent composition. Further, the soil release polymer, optionally including additional but not all components of the laundry detergent composition may be provided in an encapsulated form, and the soil release polymer encapsulate is combined with particulates containing a substantial balance of components of the laundry detergent composition.

Methods of Using Fabric Care Compositions

The fabric care compositions disclosed in the present specification may be used to clean or treat a fabric or textile. Typically at least a portion of the fabric is contacted with an embodiment of the aforementioned fabric care compositions, in neat form or diluted in a liquor, for example, a wash liquor and then the fabric may be optionally washed and/or rinsed. In one aspect, a fabric is optionally washed and/or rinsed, contacted with an embodiment of the aforementioned fabric care compositions and then optionally washed and/or rinsed. For purposes of the present disclosure, washing includes but is not limited to, scrubbing, and mechanical agitation. The fabric may comprise most any fabric capable of being laundered or treated.

The fabric care compositions disclosed in the present specification can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith. An effective amount of the fabric care composition, such as the liquid detergent compositions disclosed in the present specification, may be added to water to form aqueous laundering solutions that may comprise from about 500 to about 7,000 ppm or even from about 1,000 to about 3,000 pm of fabric care composition.

In one aspect, the fabric care compositions may be employed as a laundry additive, a pre-treatment composition and/or a post-treatment composition.

While various specific embodiments have been described in detail herein, the present disclosure is intended to cover various different combinations of the disclosed embodiments and is not limited to those specific embodiments described herein. The various embodiments of the present disclosure may be better understood when read in conjunction with the following representative examples. The following representative examples are included for purposes of illustration and not limitation.

Test Methods

Number Average Molecular Weight

Molecular weight was measured by traditional gel permeation chromatography (GPC).

EXAMPLES

Synthesis Methods

Cationic Polysaccharide:

In one aspect of the invention, cationic polysaccharides refer to polysaccharides that have been chemically modified to provide the polysaccharides with a positive charge in aqueous solution, such as by substitution with a quaternary ammonium substituent or an amine substituent that may become cationic under mildly acidic conditions. This chemical modification includes, but is not limited to, the addition of amino and/or ammonium group(s) into the biopolymer molecules. Non-limiting examples of these ammonium groups may include substituents such as trimethylhydroxypropyl ammonium chloride, dimethylstearylhydroxypropyl ammonium chloride, or dimethyldodecylhydroxypropyl ammonium chloride. See Solarek, D. B., *Cationic Starches in Modified Starches: Properties and Uses*, Wurzburg, O. B., Ed., CRC Press, Inc., Boca Raton, Fla. 1986, pp 113-125.

Anionic Polysaccharide Modification:

In another aspect of the present disclosure, anionic polysaccharides refer to polysaccharides that have been chemically modified to provide the polysaccharides with a negative charge in aqueous solution. This chemical modification includes, but is not limited to, the addition of an anionic group(s) to the dispersant polymer, such as, for example, carboxylate ($—COO^-$), carboxymethyl ($—CH_2COO^-$), succinate ($—OOCCH_2CH_2COO^-$), sulfate ($—OS(O_2)O^-$), sulfonate ($—S(O_2)O^-$), arylsulfonate ($—Ar—S(O_2)O^-$, where Ar is an aryl ring), phosphate ($—OPO_2(OR')^-$ or $—OPO_3^{2-}$, where R' is a H, alkyl, or aryl), phosphonate ($—PO_2(OR')^-$ or $PO_3^{2-}$, where R' is a H, alkyl, or aryl), dicarboxylate ($—Y(COO^-)_2$, where Y is alkyl or aryl), or polycarboxylate ($—Y(COO^-)_t$, where Y is alkyl or aryl and t is greater than 2). Such derivatization reactions are known in the art, for example, carboxymethylated polysaccharides may be made according to the procedure set forth in Hofreiter, B. T., *Carboxymethyl Starches in Modified Starches: Properties and Uses*, Wurzburg, O. B., Ed., CRC Press, Inc., Boca Raton, Fla. 1986, pp 185-188.; direct oxidation of the C6 carbon on the polysaccharide to give the C6 carboxylate (or carboxylic acid derivative) or aldehyde may be performed according to procedures set forth in U.S. Pat. Nos. 5,501,814 and 5,565,556, U.S. Application Publication No. 2007/0015678 A1, or Bragd, P. L., et al., "TEMPO-mediated oxidation of polysaccharides: survey of methods and applications." *Topics in Catalysis,* 27, 2004, 49-66; and succinates and alkenyl succinates may be made according to the procedures set forth in Trubiano, P. C., *Succinate and Substituted Succinate Derivatives of Starch: Properties and Uses*, Wurzburg, O. B., Ed., CRC Press, Inc., Boca Raton, Fla. 1986, pp 131-147 or U.S. Application Publication No. 2006/0287519 A1.

Alkoxy Polysaccharide Modification:

In another aspect of the present disclosure, alkoxy polysaccharides refer to polysaccharides that have been chemically modified to provide the polysaccharides with an alkoxy substitution. This chemical modification includes, but is not limited to, the substitution of a hydroxyethyl group ($—CH_2CH_2OH$), hydroxypropyl group ($—CH_2CH(CH_3)OH$), hydroxybutyl group ($—CH_2CH(CH_2CH_3)OH$), polyethyleneoxy groups, polypropyleneoxy groups and polybutyleneoxy groups onto a free hydroxyl group on the polysaccharide backbone. Such derivatization reactions are known in the art, for example, hydroxypropylated polysaccharides may be made according to the procedure set forth in Tuschhoff, J. V., *Hydroxypropylated Starches in Modified Starches: Properties and Uses*, Wurzburg, O. B., Ed., CRC Press, Inc., Boca Raton, Fla. 1986, pp 79-95. Hydroxyethylated polysaccharides and hydroxybutylated polysaccharides are made using a similar method except using ethylene oxide and butylenes oxide, respectively, instead of propylene oxide.

Example 1

In this Example randomly substituted cellulose is synthesized. Six different samples are synthesized using the procedure below. The number average molecular weight and the weight average molecular weight are determined.

The randomly substituted cellulose is synthesized using the following steps. Into a 2 L beaker with overhead mixer and heating plate distilled water (1200 g) is added and CMC (70.40 g) is mixed in. The sample is heated gently to 45° C. When the reaction temperature is reached 1 N HCl (14 mL) is mixed in to adjust the pH to 4-5. A preheated aqueous solution at ~50° C. of $NaH_2PO_4$ (0.51 g), acetic acid (1 small drop), and cellulose (0.21 g) in water (200.78 g) is added. The solution is mixed well. The extremely viscous solution looses viscosity rapidly. Samples A, B, C, & D are taken at time=10, 20, 30, & 50 minutes respectively. Samples are taken by pouring ~300 mL of the cellulose mixture into a beaker filled with ~600 mL of a 70/30 volume mixture of ethanol/1 N sodium hydroxide. An addition 500 mL of ethanol is added to each beaker to aide in precipitation of the modified cellulose. The samples are decanted, the effluent discarded and the solids are redissolved in ~80° C. water (200 mL). The new solutions are allowed to cool. The cooled solutions are poured into 800 mL of absolute ethanol and a precipitate forms. The precipitate is allowed to sit overnight in this solution. The materials are filtered and washed once with absolute ethanol. The samples are then placed under vacuum to dry.

The samples are removed from the vacuum oven and differentiated by GPC. The number average molecular weight ($M_n$) and the weight average molecular weight ($M_w$) (measured in Daltons) are presented in Table 1.

TABLE 1

Average Molecular Weight of Samples

| Sample | $M_n$ | $M_w$ |
|---|---|---|
| A | 16,190 | 28,300 |
| B | 12,890 | 21,660 |
| D1 | 9,590 | 15,180 |
| D2 | 10,900 | 17,690 |
| E | 42,140 | 114,750 |
| F | 23,430 | 53,075 |

Example 2

In this Example, several different charged modified cellulose polymers were synthesized. The number average molecular weight and the degree of substitution (DS) are determined. The results are presented in Table 2.

TABLE 2

Molecular Weight and Degree of Substitution

| Sample | Polymer | $MW_n$ | Anionic DS | Cationic DS |
|---|---|---|---|---|
| G | 2-hydroxyethyl cellulose | 90K | — | 0 |
| H | hydroxypropyl cellulose | 100K | — | 0 |
| I | carboxy methyl cellulose, Na, with cationic functional group DS = 0.005 | 100K | 1.2 | 0.005 |
| J | carboxy methyl cellulose, Na, with cationic functional group DS = 0.01 | 50K | 0.7 | 0.01 |
| K* | 2-hydroxyethyl cellulose, hydrophobiclly modified | | 0.75 | 0 |
| L* | methyl cellulose | 86K | — | 0 |

Example 3

Cleaning Composition Formulation

Sample formulations are prepared utilizing modified polysaccharides soil release polymer according to one aspect of the present disclosure. The formulations are prepared using standard industry practice to mix the ingredients. Formulations I, II, and III include 1% by weight of the modified polysaccharide soil release polymer whereas Formulation IV includes 3% by weight of the modified polysaccharide soil release polymer. The compositions of the four formulations are set forth in Table 3. The example cleaning composition formulations are examined to establish their ability to promote release of hydrophilic or hydrophobic soil and/or staining materials from a treated fabric surface during a washing process.

TABLE 3

Cleaning Composition Formulations

| Ingredients | Formulation I | Formulation II | Formulation III | Formulation IV |
|---|---|---|---|---|
| Sodium alkylbenzenesulfonate | 16.0000 | 14.0000 | 12.0000 | 7.9 |
| Sodium alkyl alcohol ethoxylate (3) sulfate | — | — | — | 4.73 |
| Sodium mid-cut alkyl sulfate | | 1.5000 | 1.5000 | — |
| Alkyl dimethyl hydroxyethyl quaternary amine (chloride) | — | — | — | 0.5 |
| Alkyl ethoxylate | 1.3000 | 1.3000 | 1.3000 | — |
| Polyamine[1] | — | — | — | 0.79 |
| Nonionic Polymer[2] | 1.0000 | 1.0000 | 1.0000 | 1.0 |
| Carboxymethylcellulose | 0.2000 | 0.2000 | 0.2000 | 1.0 |
| Sodium polyacrylate | — | — | — | — |
| Sodium polyacrylate/ maleate polymer | 0.7000 | 0.7000 | 0.7000 | 3.5 |
| Modified Polysaccharides[5] | 1.0000 | 1.0000 | 1.0000 | 3.0000 |
| Sodium tripolyphosphate | 10.0000 | 5.0000 | — | — |
| Zeolite | 16.0000 | 16.0000 | 16.0000 | — |
| Citric Acid | — | — | — | 5.0 |
| Sodium Carbonate | 12.5000 | 12.5000 | 12.5000 | 25.0 |
| Sodium Silicate | 4.0 | 4.0 | 4.0 | — |
| Enzymes[3] | 0.30 | 0.30 | 0.30 | 0.5 |
| Minors including moisture[4] | balance | balance | balance | balance |

[1]Hexamethylenediamine ethoxylated to 24 units for each hydrogen atom bonded to a nitrogen, quaternized.

[2]Comb polymer of polyethylene glycol and polyvinylacetate

[3]Enzyme cocktail selected from known detergent enzymes including amylase, cellulase, protease, lipase.

[4]Balance to 100% can, for example, include minors like optical brightener, perfume, suds suppresser, soil dispersant, soil release polymer, chelating agents, bleach additives and boosters, dye transfer inhibiting agents, aesthetic enhancers (example: Speckles), additional water, and fillers, including sulfate, $CaCO_3$, talc, silicates, etc.

[5]Modified celluloses and starches as synthesized in Examples 1-2 are used in the formulations.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Disclosure are, in relevant part, incorporated herein by reference; the citation of any document is not to be construed as an admission that it is prior art with respect to the present disclosure. To the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising a soil release polymer comprising a randomly substituted linear or branched polymer backbone having a structure:

$$\text{-(monomer)-(monomer)-}, \quad \text{monomer} \rightarrow (R)_p$$

wherein the randomly substituted polymer backbone comprises the residues of at least one unsubstituted monomer and at least one substituted monomer, wherein the residues of the at least one unsubstituted and the at least one substituted monomers are independently selected from the group consisting of amino acid residues, furanose residues, 1-4 Alpha-D glucopyranose residues, 1-6 alpha D-glucopyranose residues, and mixtures of any thereof, and the residue of the substituted monomer further comprises —$(R)_p$ substituent groups, wherein:

p is an integer from 1 to 3, and each R substituent is independently selected from the group consisting of anionic substituent, alkoxy substituent, or nitrogen containing substituent; and the R substituents are selected such that the soil release polymer has:

a. a degree of substitution ranging from 0.1 to 2.0 of an anionic substituent and a degree of substitution ranging from 0.001 to 0.05 of a nitrogen containing substituent;

b. a degree of substitution ranging from 0.01 to 2.0 of an alkoxy substituent and a degree of substitution ranging from 0.001 to 0.05 of a nitrogen containing substituent; or c. a degree of substitution ranging from 0.01 to 2.0 of an alkoxy substituent, a degree of substitution ranging from 0.1 to 2.0 of an anionic substituent and a degree of substitution ranging from 0.001 to 0.05 of a nitrogen containing substituent; and wherein the soil release polymer has a weight average molecular weight ranging from 500 Daltons to 1,000,000 Daltons.

2. The fabric care composition of claim 1, wherein the randomly substituted polymer backbone is selected from the group consisting of a randomly substituted starch backbone.

3. The fabric care composition of claim 1, further comprising at least one or more adjuncts selected from the group consisting of bleach activators, surfactants, builders, chelating agents, dye transfer inhibiting agents, dispersants, enzymes, enzyme stabilizers, catalytic metal complexes, polymeric dispersing agents, clay and soil removal/anti-redeposition agents, brighteners, suds suppressors, dyes, perfumes, perfume delivery systems, structure elasticizing agents, fabric softeners, carriers, hydrotropes, processing aids, and pigments.

4. The fabric care composition of claim 1, wherein the fabric care product is selected from the group consisting of liquid laundry detergents, solid laundry detergents, laundry soap products, and laundry spray treatment products.

5. A fabric care composition comprising a soil release polymer comprising a randomly substituted polymer backbone comprising unsubstituted and substituted 1-4 alpha-D glucopyranose residues and 1-6 alpha D-glucopyranose residues and having a general structure according to Formula I:

I

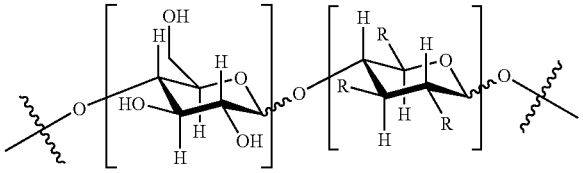

wherein each substituted 1-4 Alpha-D glucopyranos residues, 1-6 alpha D-glucopyranose residues independently comprises:

from 1 to 3 R substituents, which may be the same or different on each substituted 1-4 Alpha-D glucopyranos residues, 1-6 alpha D-glucopyranose residues, and wherein each R substituent is independently a substituent selected from the group consisting of: hydroxyl, hydroxymethyl, $R^1$, $R^2$, $R^3$ and a polymer branch having a general structure according to Formula I, and wherein the R substituents are selected such that the soil release polymer has:

each $R^1$ being independently, the same or different, having a degree of substitution ranging from 0.001 to 0.05 and a structure according to Formula II:

II

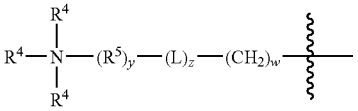

wherein each $R^4$ is a substituent selected from the group consisting of a lone pair of electrons; H; $CH_3$; linear or branched, saturated or unsaturated $C_2$-$C_{18}$ alkyl, provided that at least two of the $R^4$ groups are not a lone pair of electrons, $R^5$ is a linear or branched, saturated or unsaturated $C_2$-$C_{18}$ alkyl chain or a linear or branched, saturated or unsaturated secondary hydroxy($C_2$-$C_{18}$) alkyl chain, L is a linking group selected from the group consisting of —O—, —C(O)O—, —$NR^9$—, —C(O)

$NR^9$—, and —$NR^9C(O)NR^9$—, and $R^9$ is H or $C_1$-$C_6$ alkyl, w has a value of 0 or 1, y has a value of 0 or 1, and z has a value of 0 or 1, each $R^2$ being independently, the same or different, having a degree of substitution of 0 or ranging from 0.1 to 2.0 and a structure according to Formula III:

III

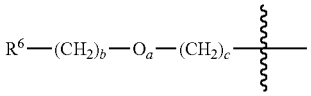

wherein $R^6$ is an anionic substituent selected from the group consisting of carboxylate, carboxymethyl, succinate, sulfate, sulfonate, arylsulfonate, phosphate, phosphonate, dicarboxylate, and polycarboxylate, a has a value of 0 or 1, b is an integer from 0 to 18, and c has a value of 0 or 1, each $R^3$ being independently, the same or different, having a degree of substitution of 0 or ranging from 0.01 to 2.0, and having a structure according to Formula IV:

IV

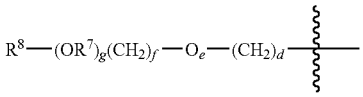

wherein d has a value of 0 or 1, e has a value of 0 or 1, f is an integer from 0 to 8, g is an integer from 0 to 50, each $R^7$ is the group ethylene, propylene, butylene, or mixtures thereof, and $R^8$ is an end group selected from the group consisting of hydrogen, $C_1$-$C_{20}$ alkyl, hydroxy, —$OR^1$ and —$OR^2$;

wherein the degrees of substitution of $R^2$ and $R^3$ are not both 0, and wherein the soil release polymer has a weight average molecular weight ranging from 500 Daltons to 1,000,000 Daltons.

6. The fabric care composition of claim 5, wherein each R substituent is independently a substituent selected from hydroxyl, hydroxymethyl, $R^1$, $R^2$, $R^3$ and a polymer branch having a general structure according to Formula I, $R^2$ has a degree of substitution ranging from 0.1 to 2.0 and $R^3$ has a degree of substitution ranging from 0.01 to 2.0.

7. The fabric care composition of claim 5, wherein the soil release polymer has a weight average molecular weight ranging from 50,000 Daltons to 200,000 Daltons.

8. The fabric care composition of claim 5, wherein (OR') has a structure —O—$CH(R^{10})CH_2$—, wherein $R^{10}$ is methyl or ethyl.

9. The fabric care composition of claim 5, wherein the randomly substituted polymer backbone is a randomly substituted starch backbone having the general structure according to Formula IB:

IB

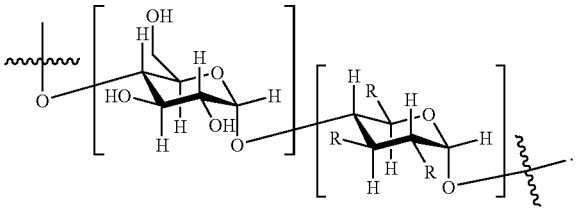

10. The fabric care composition of claim 9, wherein the randomly substituted starch backbone is derived from a starch selected from corn starch, wheat starch, rice starch, waxy corn starch, oat starch, cassava starch, waxy barley starch, waxy rice starch, glutenous rice starch, sweet rice starch, potato starch, tapioca starch, sago starch, high amylose starch, or mixtures of any thereof.

11. The fabric care composition of claim 10, wherein the randomly substituted starch backbone is derived from a high amylose starch having an amylose content of from about 30% to about 90% by weight.

12. The fabric care composition of claim 9, wherein the randomly substituted starch backbone is a randomly substituted amylopectin backbone, further comprising at least one $\alpha(1\rightarrow6)$ polyglucopyranose branch, wherein the polyglucopyranose branch comprises unsubstituted and substituted glucopyranose residues.

* * * * *